US012674375B2

(12) United States Patent
Gurevich

(10) Patent No.: US 12,674,375 B2
(45) Date of Patent: Jul. 7, 2026

(54) DOWNHOLE VIBRATION ENERGY HARVESTER FOR LOW POWER APPLICATIONS

(71) Applicant: Schlumberger Technology Corporation, Sugar Land, TX (US)

(72) Inventor: Mikhail Alexandrovich Gurevich, Menlo Park, CA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 232 days.

(21) Appl. No.: 18/706,311

(22) PCT Filed: Nov. 17, 2022

(86) PCT No.: PCT/US2022/050180

§ 371 (c)(1),
(2) Date: Apr. 30, 2024

(87) PCT Pub. No.: WO2023/091533

PCT Pub. Date: May 25, 2023

(65) Prior Publication Data

US 2026/0139571 A1 May 21, 2026

Related U.S. Application Data

(60) Provisional application No. 63/264,218, filed on Nov. 17, 2021.

(51) Int. Cl.
*E21B 41/00* (2006.01)

(52) U.S. Cl.
CPC ..... *E21B 41/0085* (2013.01)

(58) Field of Classification Search
CPC ..... E21B 41/0085
See application file for complete search history.

(56) References Cited

U.S. PATENT DOCUMENTS 10,145,215 B2 * 12/2018 Hay ..... E21B 41/0085
11,421,513 B2 * 8/2022 Gooneratne ..... E21B 47/12
(Continued)

FOREIGN PATENT DOCUMENTS

CN 104937208 A 9/2015
EP 2497899 A2 9/2012

OTHER PUBLICATIONS

Search Report and Written Opinion of International Patent Application No. PCT/US2022/050180; Dated Apr. 6, 2023; 8 pages.
(Continued)

*Primary Examiner* — D. Andrews
(74) *Attorney, Agent, or Firm* — Kyle R. Miiller

(57) ABSTRACT

A method including drilling a wellbore using a drill bit connected to a drill string. The drill string includes a vibrational energy harvester and a tool disposed inside a casing of the drill string. The vibrational energy harvester includes a stator including a conductive coil, and a rotor including magnets disposed outside the conductive coil. The rotor is unpowered. The rotor is free to rotate outside the conductive coil, and the rotor is unattached to other components of the drill string. The method also includes generating vibrations in the drill string by engaging the drill bit to a bottom of the wellbore. The method also includes harvesting electricity generated in the stator as the rotor rotates in response to the vibrations. The method also includes supplying, via an electrical connection between the stator and the tool, the electricity to the tool.

18 Claims, 5 Drawing Sheets

(56) References Cited

U.S. PATENT DOCUMENTS

| | | | | |
|---|---|---|---|---|
| 2012/0103690 | A1* | 5/2012 | Patel | E21B 10/08 175/57 |
| 2013/0026766 | A1 | 1/2013 | Ocalan | |
| 2016/0102529 | A1 | 4/2016 | DiSantis | |
| 2018/0187520 | A1 | 7/2018 | Mehta | |

OTHER PUBLICATIONS

Synapse; retrieved from <https://www.slb.com/drilling/bottomhole-assemblies/drill-bits/engineered-drillstring-design/synapse-performance-insights-and-optimization-service> on Mar. 20, 2024; 1 page.

* cited by examiner

DOWNHOLE VIBRATION ENERGY HARVESTER FOR LOW POWER APPLICATIONS

CROSS-REFERENCE TO RELATED APPLICATIONS

This application is a National Stage entry of International Patent Application No. PCT/US2022/050180, filed Nov. 17, 2022, which claims priority to U.S. Provisional Application Ser. No. 63/264,218, filed Nov. 17, 2021, the entirety of which is hereby incorporated by reference.

BACKGROUND

Wells are drilled using a drill bit attached to a pipe assembly called a drill string. The drill string extends from near the bottom of a well to the surface. A lower portion of a drill string may include a variety of components, such as a drill bit, one or more collars, and drilling tools. Together, the components may be referred to as a bottom-hole assembly (BHA).

Some components of the BHA may use electrical power. As it is often not practical to connect an electrical power line from the surface to the BHA, one or more batteries may be used to power the electrical components of the BHA. However, batteries have a limited lifetime. As some wells may be miles deep, ceasing drilling operations and removing the drill string from a well in order to replace a battery in the BHA may be considered undesirable.

SUMMARY

The one or more embodiments provide for a method including drilling a wellbore using a drill bit connected to a drill string. The drill string includes a vibrational energy harvester and a tool disposed inside a casing of the drill string. The vibrational energy harvester includes a stator including a conductive coil, and a rotor including magnets disposed outside the conductive coil. The rotor is unpowered. The rotor is free to rotate outside the conductive coil, and the rotor is unattached to other components of the drill string. The method also includes generating vibrations in the drill string by engaging the drill bit to a bottom of the wellbore. The method also includes harvesting electricity generated in the stator as the rotor rotates in response to the vibrations. The method also includes supplying, via an electrical connection between the stator and the tool, the electricity to the tool.

The one or more embodiments also provide for a system to harvest downhole energy, including a first element disposed on a drill string, the first element including conductive coils. The system also includes a second element suspended outside the first element, the second element including permanent magnets. Movement of the drill string causes torsional oscillations of the second element. The second element is unattached to the first element and to other components of the drill string. Current is induced in the conductive coils due to a changing magnetic field.

The one or more embodiments also provide for a device including a drill string having a casing. The device also includes a tool disposed inside a casing of the drill string. The tool includes an electrical connection and an electrically powered mechanism. The device also includes a vibrational energy harvester connected to the drill string and electrically connected to the electrical connection. The vibrational energy harvester includes a stator comprising a conductive coil. The vibrational energy harvester also includes a rotor including magnets disposed outside the conductive coil. The rotor is unpowered. The rotor is free to rotate outside the conductive coil. The rotor is unattached to other components of the drill string.

Other aspects of the one or more embodiments will be apparent from the following description and the appended claims.

BRIEF DESCRIPTION OF DRAWINGS

Like elements in the various figures are denoted by like reference numerals for consistency.

DETAILED DESCRIPTION

Figure 1:
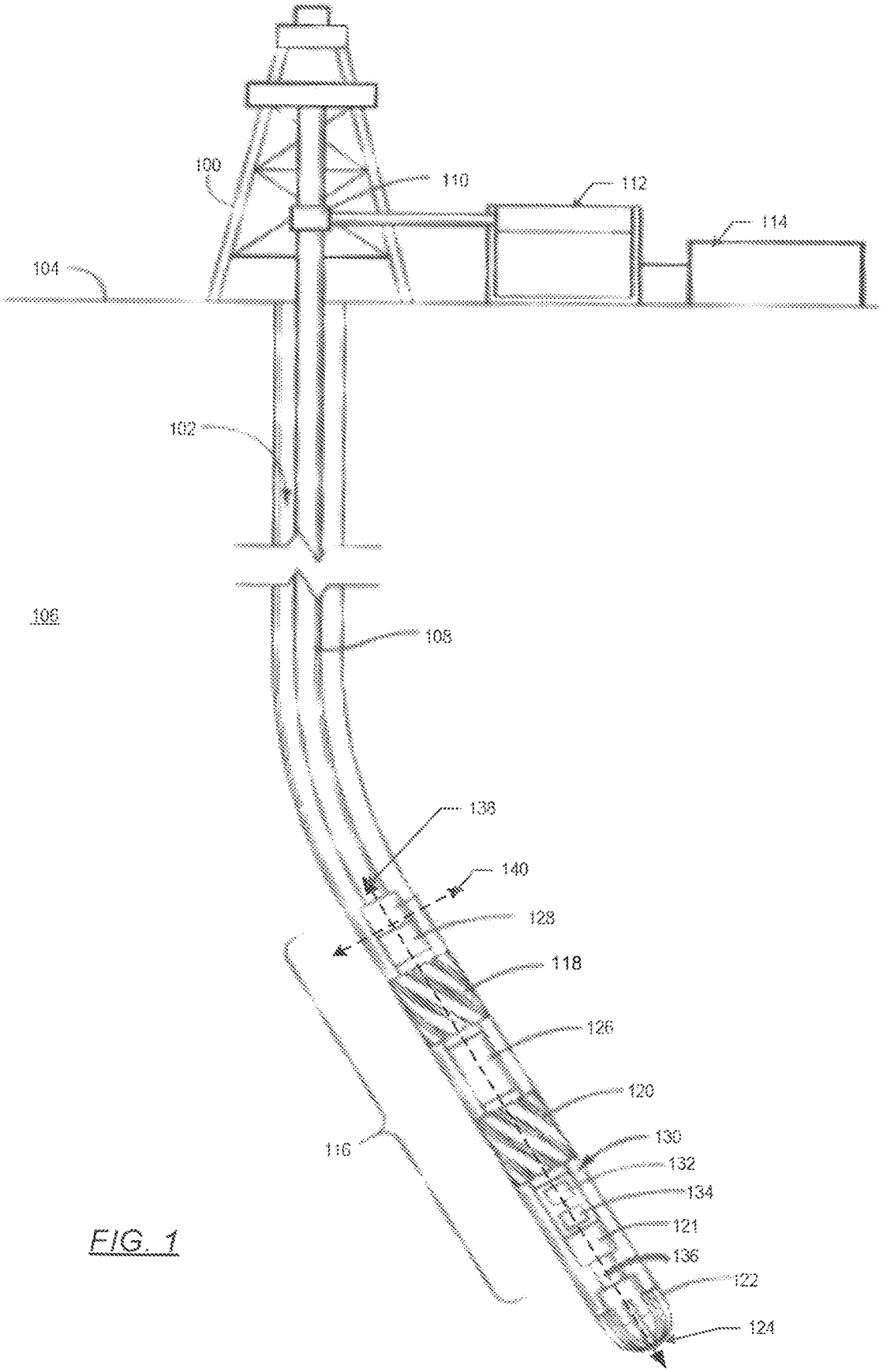
FIG. 1 shows a vibrational energy harvester, in accordance with one or more embodiments.

In general, embodiments are directed to a vibrational energy harvester which may generate electrical power using the vibrations that occur in a bottom hole assembly (BHA) of a drill string during a drilling operation. The generated electrical power may be used to power tools in the BHA, or elsewhere in the drill string, that operate using an electrical current.

The vibrational energy harvester, also known as a system to harvest downhole energy, may be a component in the BHA. The vibrational energy harvester may be located near the end of the drill string, near the bottom of a well being drilled.

As a drill bit grinds the rock or soil at the bottom of the well, the drill bit, the BHA, and other portions of the drill string vibrate. In particular, the teeth of the drill bit apply pressure to the rock or soil. When the pressure builds above some threshold amount of pressure, the rock or soil cracks or breaks. The drill bit teeth then jerk as the teeth advance into the broken formation. The well becomes slightly deeper as the broken material is driven upwardly for removal. The teeth then suddenly stop against fresh rock or soil, and the process repeats. The process of stopping of the drill bit teeth, breaking of the soil, and continued motion of the drill bit teeth may occur rapidly (e.g., in less than a second) and intermittently (e.g., not in the same time intervals). As a result, substantial vibrations may occur in the drill bit, BHA, and drill string, as indicated above. The predominant type of vibrations are torsional vibrations (vibrations that tend to rotate an object), though some linear vibrations (vibrations that tend to move an object axially) may also occur. Torsional vibrations may also be called radial vibrations. Linear vibrations may also be called axial vibrations, which generate axial movement of the drill string or components within the drill string.

The one or more embodiments harvest some of the vibrational energy transferred to the BHA due to the operation of the drill bit. In particular, the one or more embodiments take advantage of Faraday's law of induction to transform a fraction of the vibrational energy into electrical energy.

Specifically, the vibrational energy harvester of the one or more embodiments includes a stator and an unattached rotor disposed outside the stator. The stator is a housing around which are wound electrical conductors (e.g., electrical wiring such as copper). The rotor is formed of two or more magnets. The term "unattached" means that the rotor is not directly connected to, in either a fixed sense or a removable sense, to other components The vibrational energy harvester is located in the BHA. As the BHA is rotated and experiences torsional oscillations, the stator, which is connected to the BHA, rotates with the BHA. The rotor, being unattached, assumes an average rotational speed of the BHA due to residual friction in the bearings and electromagnetic coupling with the stator. However, fast torsional vibrations do not affect the average rotor speed due to high inertia and free-rotating design of the rotor. Thus, the stator and the rotor effectively rotate relative to each other while the BHA vibrates. The resulting relative motion between the stator and the rotor creates a changing magnetic field in the stator. The changing magnetic field induces an electric current in the stator. The electric current may be harvested using an electrical connection attached to the stator. The harvested electric current then may be used to power other tools located in the BHA.

Attention is now turned to the figures. FIG. 1 shows a drilling rig (100) drilling a wellbore (102) in a surface (104) of a formation (106) in the Earth using a drill string (108). A top drive (110) may drive the drilling process. Mud stored in a tank (112) may be pumped into the drill string (108) and/or the wellbore (102) in order to facilitate the drilling operation. Workers, computers, and other equipment may be housed in a building (114).

The drill string (108) is a long pipe, which may be segmented, that may include a variety of components used to drill the wellbore (102). Near the end of the drill string (108) is a bottom hole assembly, referred to as a BHA (116). The BHA (116) includes a variety of tools and equipment useful in performing and/or monitoring the drilling operation. For example, the BHA (116) may include a first stabilizer (118) and a second stabilizer (120) used to stabilize the drill string (108). A steering unit (121) may be used to help guide the BHA (116) during a drilling operation.

At the end of the BHA (116) of the drill string (108) is a drill bit (122). The drill bit (122) is used to drill into the bottom (124) of the wellbore (102). During a drilling operation, the drill bit (122) experiences vibrations, which are transferred to the rest of the BHA (116) and other parts of the drill string (108), as described above.

The drill string (108) also includes one or more tools disposed in, on, or otherwise connected to the drill string (108). A tool is a device designed to perform a function during a drilling operation. Many of the tools are placed in the BHA (116).

There are many kinds of tools used in a drilling operation. Examples of tools include Measurement While Drilling (MWD) instruments, such as MWD tool (126) designed to measure the borehole direction. Other tools include Logging While Drilling (LWD) sensors, such as LWD tool (128), designed to measure rock formation properties. Other tools include a control unit (130) that may include a processor (132), and a drilling sensor (134). Still other types of tools are possible, such as a downhole drilling dynamics data recorder or a wellbore monitoring device.

In. yet another example, the tool may be a computer processor programmed with a machine learning model or some other form of artificial intelligence (AI). Such a computer processor (e.g., processor (132)) may use a higher current than that which could be provided using batteries over a desired time period. The data recorders mentioned above may themselves support AI-driven drilling measurement workflows. Existing downhole devices lack functional capabilities and power reserves to produce AI-ready data. Thus, a combination of Industrial Internet of Things (IIOT) electronics and the energy harvesting capabilities of the one or more embodiments allow for a wide deployment of devices suitable to support in-situ, data-driven drilling, measurement, and analysis techniques.

Each tool may include a battery, such as a rechargeable lithium-ion battery or a lead-acid battery, to provide the desired electrical power to operate the tool. However, the electrical power for the tool or tools also may be provided by a vibrational energy harvester (136). The vibrational energy harvester (136) may operate in conjunction with one or more batteries, which are located within the tool or located elsewhere within the BHA (116) or the drill string (108). For example, the vibrational energy harvester (136) may supply electrical power to a rechargeable battery, and the rechargeable battery may supply power to the tool. However, in other embodiments, the source of power for a tool is the vibrational energy harvester (136), and the tool is thereby deemed electrically unattached to another source of electrical power.

The vibrational energy harvester (136) is disposed in or on the BHA (116) at or near the drill bit (122). The term "near" means within a pre-determined distance of the distal end of the BHA (116). The vibrational energy harvester (136) is described in more detail with respect to FIG. 2 through FIG. 4.

For clarity, a coordinate system is established with respect to describing the one or more embodiments. The term "axial" refers to a distance along, or parallel to, a longitudinal axis (138) of the drill string (108) or the BHA (116). The term "distal" refers to a location on the longitudinal axis (138), or a line parallel to the longitudinal axis (138), that is closer to the end of the drill bit (122) (e.g., closer to the bottom (124) of the wellbore (102) during a drilling operation). The term "proximal" refers to a location on the longitudinal axis (138), or parallel to the longitudinal axis (138), that is closer to the end of the drill string (108) opposite the end having the drill bit (122) (e.g., is closer to the surface (104) than to the end having the drill bit (122)). Thus, a proximal location on an item is a location or side closer to the surface (104) than remaining locations on the item that are closer to the drill bit (122).

The term "radial" refers to a distance along, or parallel to, a radial axis (140) that is perpendicular to the longitudinal axis (138). Thus, for example, the term "radial" may refer to a length along a radius or diameter of a drill string (108) that is cylindrical in shape. The term "radially outwardly" refers to a distance that extends from the longitudinal axis (138) towards an edge of the wellbore (102) along a radial line, such as the radial axis (140). The term "radially inwardly" refers to a distance that extends towards the longitudinal axis (138) along a radial line, such as the radial axis (140).

Figure 2:
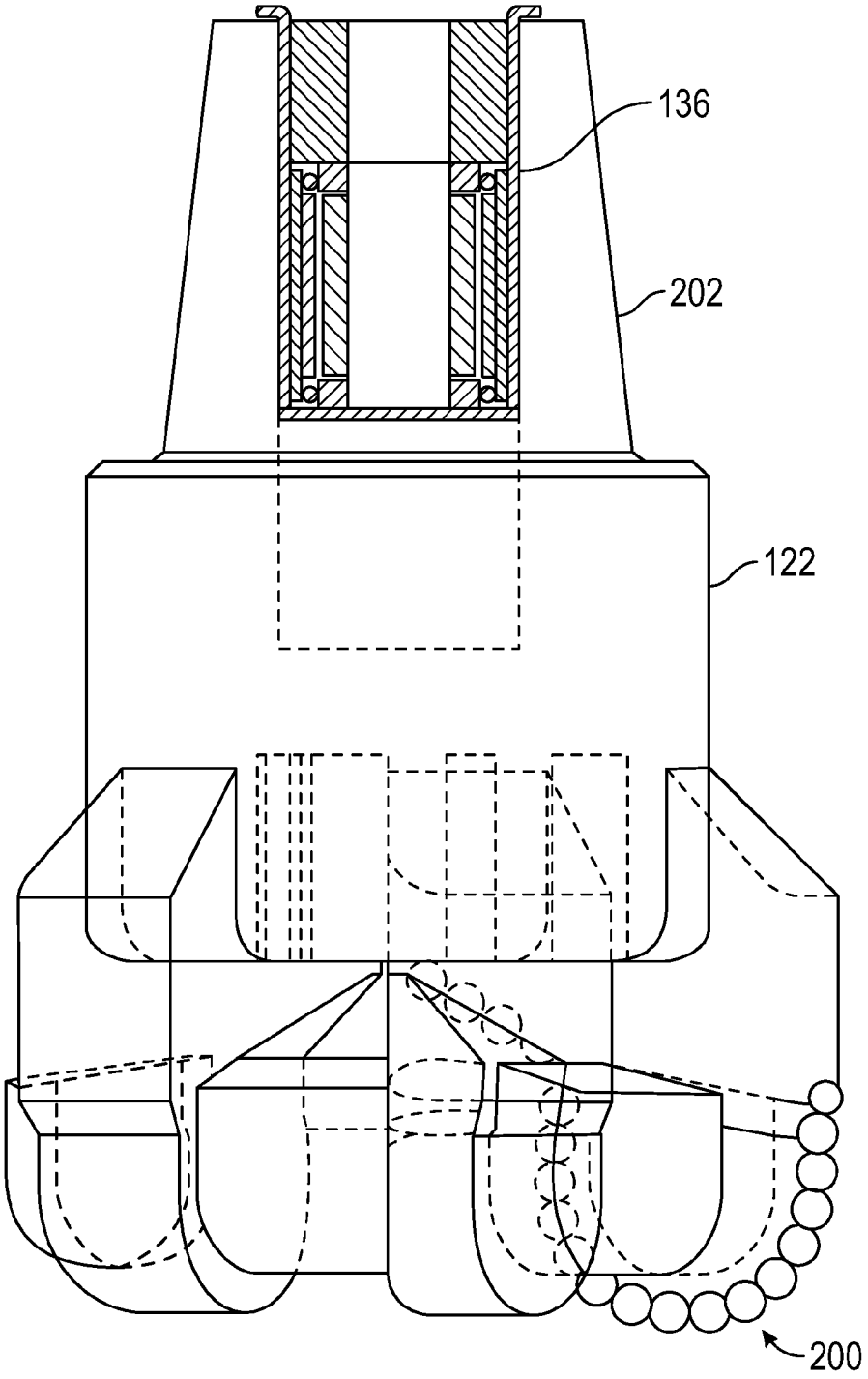
FIG. 2 shows the drill bit and vibrational energy harvester shown in FIG. 1, in accordance with one or more embodiments.

FIG. 2 shows the drill bit and vibrational energy harvester shown in FIG. 1, in accordance with one or more embodiments. Reference numerals in FIG. 2 in common with reference numerals used in FIG. 1 refer to common objects having common definitions. Thus, for example, the vibrational energy harvester (136) is shown for reference, just proximal of the drill bit (122). Vibrations from the teeth (200) to the drill bit (122) against the bottom of the wellbore are transferred to the vibrational energy harvester (136) through the structure (202) of the BHA (116) connected to the drill bit (122). The details of the vibrational energy harvester (136) are shown in FIG. 3 and FIG. 4.

Figure 3:
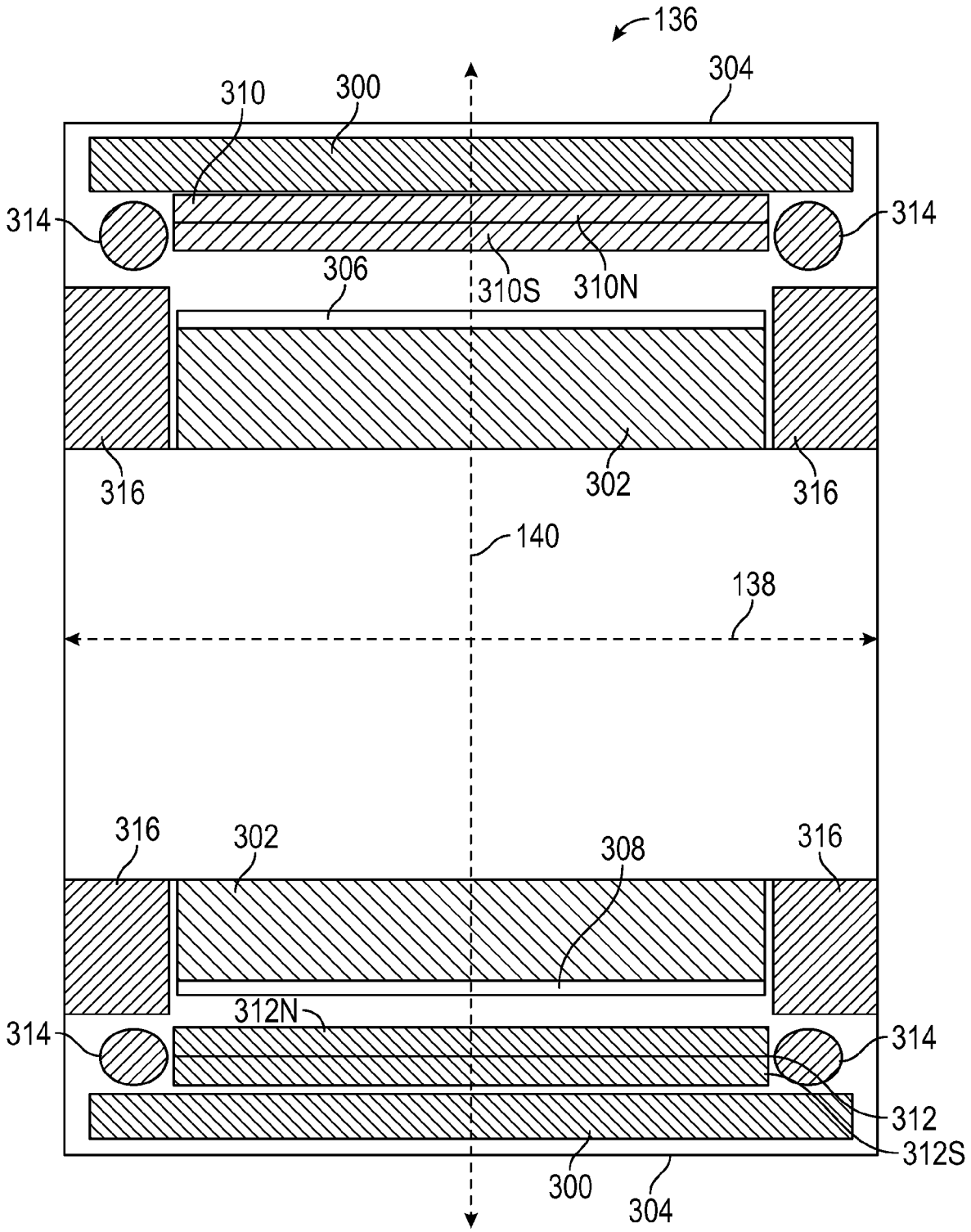
FIG. 3 shows the vibrational energy harvester shown in FIG. 1 and FIG. 2, in accordance with one or more embodiments.
Figure 4:
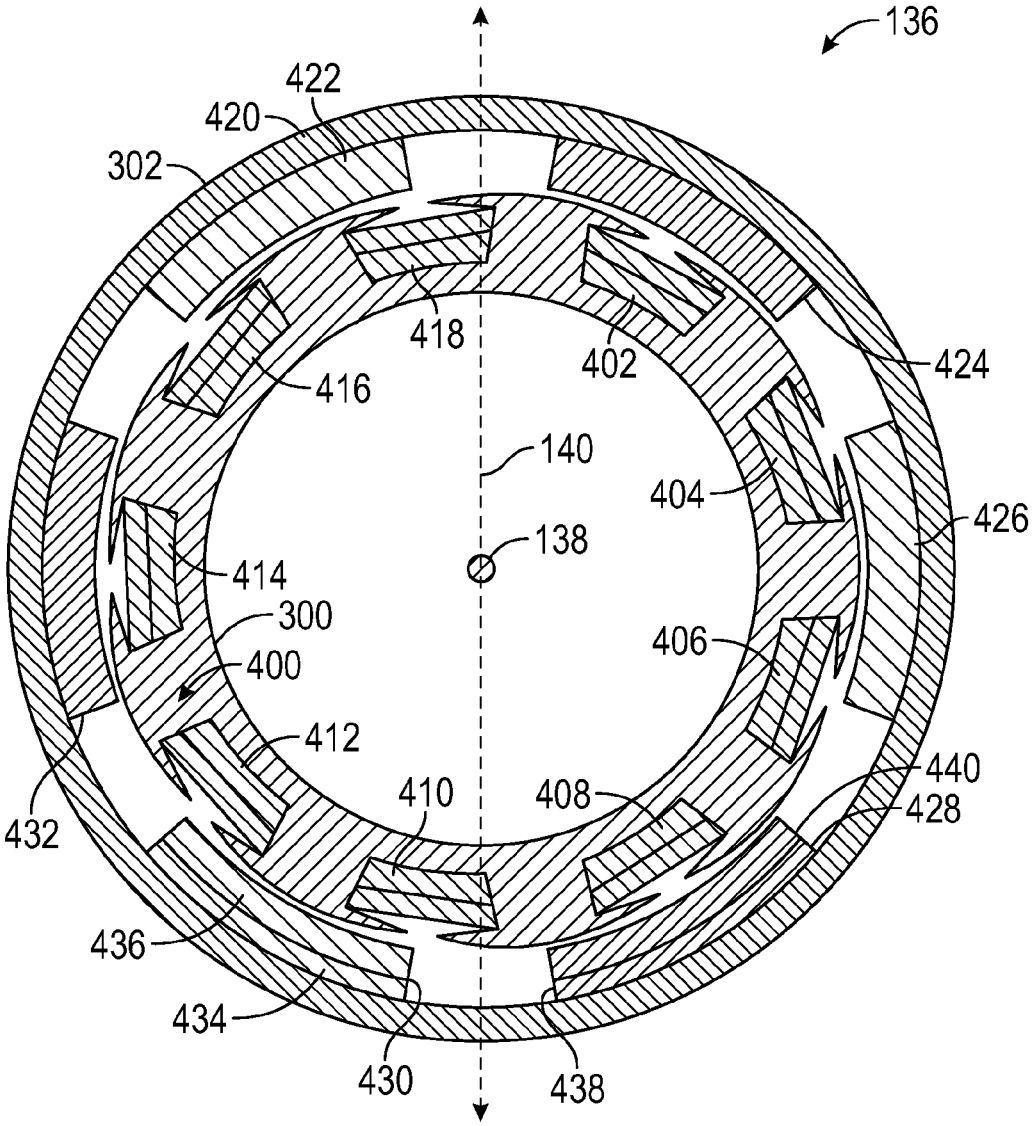
FIG. 4 shows a cross section of the vibrational energy harvester shown in FIG. 3, in accordance with one or more embodiments.

FIG. 3 shows the vibrational energy harvester (136) shown in FIG. 1 and FIG. 2, in accordance with one or more embodiments. Reference numerals in common with FIG. 1 and FIG. 2 refer to similar objects having similar descriptions and components.

The vibrational energy harvester (136) includes a rotor (300) and a stator (302). The stator (302) also may be referred to as a first element (i.e., furthest radially inwardly relative to a housing (304) of the vibrational energy harvester (136)). The rotor (300) also may be referred to as a second element (i.e., furthest radially outwardly relative to the housing (304) of the vibrational energy harvester (136)).

The stator (302) is fixed relative to the housing (304). The stator (302) may be a rigid structure having a hollow cylindrical shape. However, the stator (302) may have other shapes in other embodiments, such as that of a polygon.

Additionally, the stator (302) optionally may not be located inside the vibrational energy harvester (136), and thus not located radially inwardly of the rotor (300). For example, the stator (302) could be located on or even outside the drill string (108). So long as changing magnetic fields created by movement of the rotor (300) reach a conductive winding of the stator (302), such as windings (306) or windings (308), the vibrational energy harvester (136) will still generate an electrical current. The windings also may be referred to as electrically conducting coils.

The stator (302) also includes one or more conductive coils of wires known as windings or armature windings (e.g., the windings (306) and the windings (308)). The windings are composed of individual wires, which are not shown that wrap partially or fully around the stator (302). The windings may be axially oriented in an embodiment. In other words, the windings may be wires that are oriented along one or more lines about parallel to the longitudinal axis (138). The function of the windings is to facilitate generation of an electrical current in response to a moving magnetic field induced by movement of the rotor (300). In use, when the windings are disposed in a changing magnetic field (e.g., when the rotor (300) rotates relative to the stator (302)), then the electric current is generated in the windings. The current may be harvested via one or more electrical connectors (316).

The stator (302) may be disposed inside the rotor (300). The stator (302) may be a rigid structure having a hollow cylindrical shape that has a radius less than a radius of the rotor (300). Thus, the rotor (300) is deemed to be external to the stator (302). The stator (302) may have other shapes, such as that of a polygon. In an embodiment, the rotor (300) may be coaxial, or about coaxial, with the stator (302).

The rotor (300) may be a body that includes two or more magnets, such as magnet (310) and magnet (312). The magnets may be permanent magnets. The magnets may be embedded in a body or housing that forms a structure for the rotor (300). The magnets may be axially aligned along the longitudinal axis (138).

Each magnet is composed of a pair of opposed magnetic poles (e.g., a "north" pole and a "south" pole, though the terms "north" and "south" are nonce terms that do not necessarily correlate to the poles of planet Earth). The term "opposed" means that one magnetic pole is radially opposite another magnetic pole across a point on a line that is parallel to the radial axis (140). Thus, for example, magnet (310) includes a first north pole (310N) and a first south pole (310S). In turn, magnet (312) includes a second north pole (312N) and a second south pole (312S).

The poles of the two magnets are in an alternating relationship with respect to each other, in one embodiment. Thus, the first north pole (310N) is disposed radially outwardly relative to the first south pole (310S), but the second north pole (312N) is disposed radially inwardly relative to the second south pole (312S). When two or more such magnets are arranged in such an alternating pole arrangement around an inner surface of the rotor (300), the overall shape of the magnetic field of the rotor (300) becomes complex. The complex magnetic field shape may aid with current generation.

FIG. 3 shows that the magnet (310) and the magnet (312) are oriented axially along the rotor. However, in other embodiments, the magnet or magnets may be aligned radially, rather than axially as shown.

In one or more embodiments, the rotor (300) is unattached to other components of the drill string (108), including other components of the vibrational energy harvester (136). Again, the term "unattached" means that the rotor (300) is not directly connected to, in either a fixed sense or a removable sense, to other components. In other words, the rotor (300) is free to rotate outside the stator (302). The rotor (300) being unattached may further mean that it is optionally bounded in a particular region by the other components of the drill string (108) and may touch the other components, while not being affixed directly or indirectly to the other components. The touching of the other components may be intermittent.

Because the rotor (300) is not connected to any other components, the rotor (300) is also characterized as being unpowered. In other words, no kinetic force or electrical energy generated by a component of the vibrational energy harvester (136) can cause the rotor (300) to rotate outside the stator (302). Therefore, because the rotor (300) is both unpowered and unattached to other components, the rotor (300) rotates freely outside the stator (302).

The stator (302), on the other hand, is fixedly connected to an inside wall of the housing (304), or to some other component of the vibrational energy harvester (136), or to some other component of the drill string (108). Thus, the stator will vibrate at about the same frequency and amplitude as the vibrations caused by the drill bit (122) during a drilling operation.

Nevertheless, the rotor (300) is constrained to remain inside the vibrational energy harvester (136). The stator (302) is radially constrained inside the vibrational energy harvester (136) by the inside surface of the housing (304). The rotor (300) is axially constrained inside the vibrational energy harvester (136) by bearings (314). The bearings (314) permit the rotor (300) to rotate within the vibrational energy harvester (136) without driving the rotor (300). For example, the bearings (314) may roll as torsional vibrations urge the stator (302) to rotate around the longitudinal axis (138) and axial vibrations and/or gravity urge the stator (302) against one or more of the bearings (314).

The primary cause of relative torsional movement (i.e., rotational movement) between the stator and the rotor may be torsional vibrations that cause the rotor (300) to rotate relative to the stator (302), as explained further below. When a drilling operation is paused, the rotor (300) may not rotate outside the stator (302), as the primary source of torsional vibrations may be the impact of the drill bit on the bottom of the well.

Nevertheless, during a drilling operation, vibrations caused by the drill bit (122) will cause the drill string (108) to vibrate. The vibrations of the drill string (108) and the drill bit (122) are transferred to the outer wall of the housing (304). In turn, the vibrations will cause the vibrational energy harvester (136) to vibrate. The vibrations of the vibrational energy harvester (136) cause torsional oscillations of the stator (302). Stated differently, the vibrations cause the stator (302) to rotate back and forth around the longitudinal axis (138) relative to the rotor (300). In turn, the rotor (300) may assume an average rotational speed of the drill string (108) due to inertia, a low friction of the bearings (314), and a relatively small electromagnetic coupling to the rotor (300). However, the vibrations will still cause the rotor (300) to rotate clockwise and anti-clockwise, back and forth, around the longitudinal axis (138) relative to the stator (302).

Nevertheless, which component rotates relative to which is not relevant, as the net relative torsional motion of the rotor (300) relative to the stator (302) establishes a changing magnetic field. In turn, the changing magnetic field generates an electric current in the stator (302).

In other words, because the magnets of the rotor (300) (i.e. the paired opposing magnetic poles) move relative to the stator (302) in response to the torsional vibration, the rotor (300) generates a changing magnetic field in the windings of the stator (302). The changing magnetic field induces an electric current in the conductive coil. Because the rotor (300) frequently reverses its relative direction as a result of the vibrations, the electrical current generated is an alternating current. The alternating electric current may be harvested by one or more electrical connectors (316), or transferred to one or more other tools inside the BHA (116), or elsewhere within the drill string (108).

FIG. 4 shows a radial cross section of the vibrational energy harvester (136) shown in FIG. 3, in accordance with one or more embodiments. FIG. 4 shares reference numerals in common with FIG. 1 through FIG. 3, referring to common components having common definitions. Thus, for example, FIG. 4 refers to the vibrational energy harvester (136), which includes a stator (302) and a rotor (300).

The rotor (300) is unattached to other components within the vibrational energy harvester (136) or other components of the drill string (108) shown in FIG. 1. Thus, the rotor (300) is free to rotate unpowered outside the stator (302).

In the embodiment shown in FIG. 4, the stator (302) is formed, in part, as a cylindrical body (400). The cylindrical body (400) may be hollow, but in other embodiments the cylindrical body (400) may be solid.

The stator (302) includes nine conductive coils, conductive coil (402), conductive coil (404), conductive coil (406), conductive coil (408), conductive coil (410), conductive coil (412), conductive coil (414), conductive coil (416), and conductive coil (418). Each conductive coil represents one or more windings of a conductive wire that wraps around or is otherwise connected to the cylindrical body (400) of the stator (302). The windings may be longitudinally aligned with one or more lines that are parallel to the longitudinal axis (138).

Note that the longitudinal axis (138) is represented by a dot in FIG. 4, as the longitudinal axis (138) points into and out of the page in FIG. 4. A radial axis (140) is also shown for reference.

The rotor (300) is formed, in part, as a second cylindrical body (420), which is hollow. The rotor (300) includes six magnets, including magnet (422), magnet (424), magnet (426), magnet (428), magnet (430), and magnet (432). Each magnet includes a pair of opposing poles. For example, magnet (430) includes north pole (434) and south pole (436). The other magnets shown likewise have paired opposing poles, whether or not shown as such in FIG. 4.

In an embodiment, the magnets may be arranged in an inverted pole relationship with each other. For example, the north pole (434) of the magnet (430) may be disposed radially outwardly relative to the south pole (436) of the magnet (430). However, a south pole (438) of the magnet (428) may be disposed radially outwardly relative to the north pole (440) of the magnet (428). Thus, the poles of the magnet (430) and the poles of the magnet (428) are inverted relative to each other along a radial direction of the radial axis (140). Stated differently, the magnet (430) and the magnet (428) are arranged in an alternating inverted pole relationship with each other.

In an embodiment, the other magnets may also be arranged in alternating inverted pole relationships with each other. Thus, each pair of adjacent magnets may have a north pole disposed radially outwardly followed by a south pole disposed radially outwardly, or vice versa. However, other arrangements of the magnets of the rotor (300) are possible.

Figure 5:
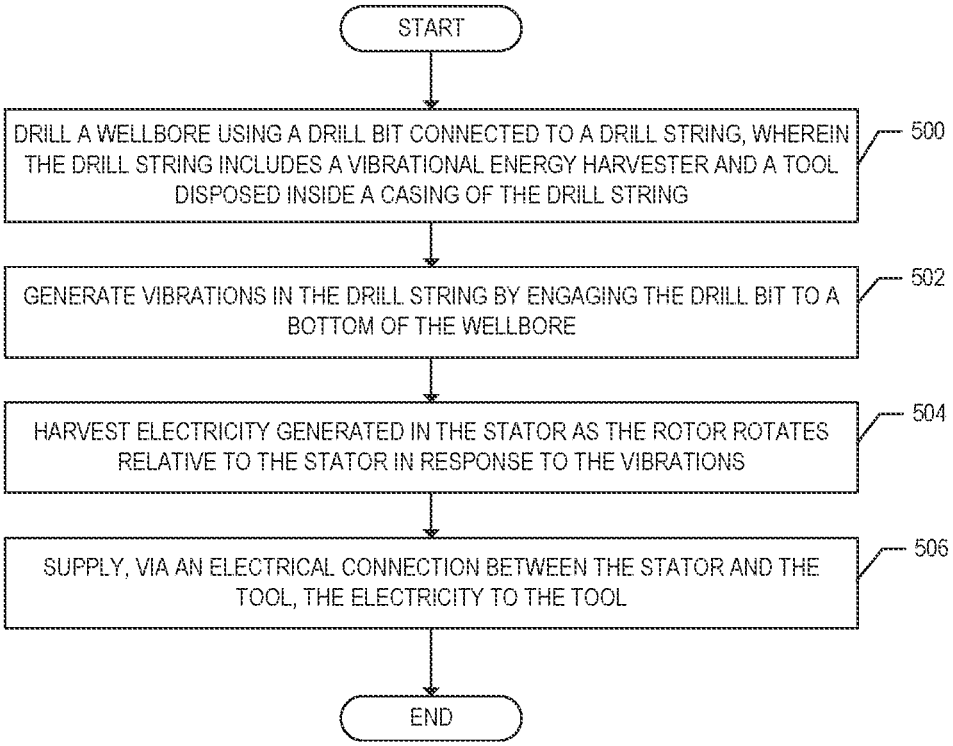
FIG. 5 is a flowchart of a method of harvesting energy, in accordance with one or more embodiments.

FIG. 5 is a flowchart of a method of harvesting energy, in accordance with one or more embodiments. The method of FIG. 5 may be performed using a vibrational energy harvester located within a drill string, such as the vibrational energy harvester (136) and the drill string (108) shown in FIG. 1, or the vibrational energy harvester (136) shown in FIG. 2, FIG. 3, or FIG. 4.

Step 500 includes drilling a wellbore using a drill bit connected to a drill string. The drill string includes a vibrational energy harvester and a tool disposed inside a casing of the drill string. The vibrational energy harvester includes a stator having a conductive coil. The vibrational energy harvester also includes a rotor including a number of magnets disposed outside the conductive coil. The rotor is unpowered. The rotor also is free to rotate outside the conductive coil. The rotor is unattached to other components of the drill string.

Step 502 includes generating vibrations in the drill string by engaging the drill bit to a bottom of the wellbore. Movement of the teeth of the drill bit due to the drilling operations may generate torsional vibrations. Additionally, larger vibrations may occur when the teeth of the drill bit alternatingly break rock or soil and then stop against the rock or soil until sufficient pressure builds to break more of the rock or soil.

Step 504 includes harvesting electricity generated in the stator as the rotor rotates relative to the stator in response to the vibrations. Harvesting may be accomplished by means of one or more electrical connectors that are in electrical communication with the energy harvesting device. The electrical connectors may be connected to additional wires, other electrical connectors, or other electrical components that supply electricity to one or more tools in the drill string.

Thus, step 506 includes supplying, via an electrical connection between the stator and the tool, the electricity to the tool. Electrical power continues to be generated and harvested until the vibrations in the energy harvesting tool stop, or an electrical connection of one or more electrical connections is broken. The electrical power may be regulated by a transformer or power regulator so that electrical current of a pre-determined voltage and frequency is applied to a tool of the drill string. The electrical power may be stored in one or more capacitors for future use.

The method of FIG. 5 may be varied. For example, the rotor may be disposed in a fluid surrounding the vibrational energy harvesting device. However, the rotor may be in a vacuum or in a gaseous environment surrounding the vibrational energy device.

In another variation, the stator may be a first cylinder and the rotor may be a second cylinder coaxial with, and outside the first cylinder. The cylinders may be hollow cylinders. However, the stator and the rotor may not be coaxial in other embodiments.

In still another embodiment, the stator is disposed outside the drill string. Thus, the energy harvesting device may be partially inside the drill string (e.g., the rotor is inside the drill string) and partially outside the drill string (e.g., the stator is outside the drill string). In a specific example, the rotor may be inside the drill string and the stator may be disposed outside an outer casing of the drill string. Thus, the rotor and stator need not be relatively close to each other, as shown in the figures, and also may be inverted with respect to each other (e.g., the rotor may be disposed inside the stator).

Still other variations are possible. For example, the stator may have a partially circular or polygonal cross section. Thus, an opening may be present in an inner diameter of the stator. Tools or other components of the drill string may be present in the stator, in this case.

The one or more embodiments also contemplate a rotor that is attached to another component (i.e., the rotor is not unattached). For example, the second element may be suspended from the first element with a mechanical spring (i.e., the rotor is suspended from the stator via a spring which may compress and decompress as the stator is vibrated).

The one or more embodiments may also be characterized as a method to harvest the downhole energy of a drill string. The method includes disposing a first element on a drill string, the first element including electric coils. The method also includes suspending a second element relative to the first element, the second element including permanent magnets. The suspending step may include suspending the second element relative to the first element in viscous fluid. The method also includes moving the drill string thereby causing torsional oscillations of the second element. The method also includes inducing current in the electric coils due to the changing magnetic field.

Other variations are possible. The suspending step may include suspending the first element and the second element coaxially. The first element may be external to the second element. The first element may be internal to the second element.

The one or more embodiments also provide for a system to harvest downhole energy. The system includes a first element disposed on a drill string, the first element including electric coils. The system also includes a second element suspended relative to the first element, the second element including permanent magnets. Movement of the drill string causes torsional oscillations of the second element. Current is induced in the electric coils due to the changing magnetic field.

Again, the second element may be suspended relative to the first element in viscous fluid. The second element may be suspended relative to the first element with a mechanical spring. The first element may be coaxial to the second element. The first element may be external to the second element. The first element may be internal to the second element.

The one or more embodiments also provide for a system to harvest downhole energy, including a first element disposed on a drill string, the first element including conductive coils. The system also includes a second element suspended outside the first element, the second element including permanent magnets. Movement of the drill string causes torsional oscillations of the first element attached to it. The second element is unattached to the first element and to other components of the drill string and minimally affected by the vibrations due to its high inertia and relatively low frictional and magnetic coupling forces. Current is induced in the conductive coils due to a changing magnetic field created by the relative movement of the two elements.

The one or more embodiments also provide for a device including a drill string having a set of tubular elements. The device also includes a tool disposed inside an element of the drill string. The tool includes an electrical connection and an electrically powered mechanism. The device also includes a vibrational energy harvester connected to the drill string and electrically connected to the electrical connection. The vibrational energy harvester includes a stator comprising a conductive coil. The vibrational energy harvester also includes a rotor including magnets disposed outside the conductive coil. The rotor is unpowered. The rotor is free to rotate outside the conductive coil. The rotor is unattached to other components of the drill string.

The term "about," when used with respect to a physical property that may be measured, refers to an engineering tolerance expected by or determined by one of ordinary skill in the art. The exact quantified degree of an engineering tolerance depends on the product being produced, the process being performed, or the technical property being measured. For a non-limiting example, two angles may be "about congruent" if the values of the two angles are within ten percent of each other. However, if the ordinary artisan determines that the engineering tolerance for a particular product should be tighter, then "about congruent" could be two angles having values that are within one percent of each other. Likewise, engineering tolerances could be loosened in other embodiments, such that "about congruent" angles have values within twenty percent of each other. In any case, the ordinary artisan is capable of assessing what is an acceptable engineering tolerance for a particular product, and thus is capable of assessing how to determine the variance of measurement contemplated by the term "about."

As used herein, the term "connected to" contemplates at least two meanings. In a first meaning, unless otherwise stated, "connected to" means that component A could have been separate from component B, but is joined to component B in either a fixed or a removably attached arrangement. In a second meaning, unless otherwise stated, "connected to" means that component A is integrally formed with component B. Thus, for example, assume a bottom of a pan is "connected to" a wall of the pan. The term "connected to" may be interpreted as the bottom and the wall being separate components that are snapped together, welded, or are otherwise fixedly or removably attached to each other. Additionally, the term "connected to" also may be interpreted as the bottom and the wall being contiguously together as a monocoque body formed by, for example, a molding process.

In the application, ordinal numbers (e.g., first, second, third, etc.) may be used as an adjective for an element (i.e., any noun in the application). The use of ordinal numbers is not to imply or create any particular ordering of the elements nor to limit any element to being a single element unless expressly disclosed, such as by the use of the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Further, unless expressly stated otherwise, the term "or" is an "inclusive or" and, as such, includes the term "and." Further, items joined by the term "or" may include any combination of the items with any number of each item, unless expressly stated otherwise.

In the above description, numerous specific details are set forth in order to provide a more thorough understanding of the technology. However, it will be apparent to one of ordinary skill in the art that the technology may be practiced without these specific details. In other instances, well-known features have not been described in detail to avoid unnecessarily complicating the description. Further, other embodiments not explicitly described above can be devised which do not depart from the scope as disclosed herein. Accordingly, the scope should be limited by the attached claims.

What is claimed is:

1. A method comprising:

drilling a wellbore using a drill bit connected to a drill string, wherein the drill string comprises a vibrational energy harvester and a tool disposed inside a casing of the drill string, the vibrational energy harvester comprising:

a stator comprising a conductive coil;

a rotor comprising a plurality of magnets disposed outside the conductive coil, wherein the rotor is unpowered and the rotor is free to rotate outside the conductive coil;

a first bearing disposed proximate a first axial end of the rotor; and a second bearing disposed proximate a second axial end of the rotor, wherein the rotor is supported for free axial movement between the first bearing and the second bearing, and wherein the first bearing and the second bearing constrain a boundary of axial movement of the rotor;

generating vibrations in the drill string by engaging the drill bit to a bottom of the wellbore;

harvesting electricity generated in the stator as the rotor rotates in response to the vibrations; and supplying, via an electrical connection between the stator and the tool, the electricity to the tool.

2. The method of claim 1, wherein the rotor is disposed in a fluid disposed within the drill bit.

3. The method of claim 1, wherein the stator comprises a first cylinder and the rotor comprises a second cylinder coaxial with the first cylinder.

4. The method of claim 1, wherein harvesting comprises harvesting an alternating current.

5. A system to harvest downhole energy, comprising:

a first element disposed on a drill string, the first element including conductive coils;

a second element suspended outside the first element, the second element including a plurality of permanent magnets, the second element suspended in a viscous fluid;

a first bearing disposed proximate a first end of the second element; and a second bearing disposed proximate a second end of the second element, wherein the second element is supported for free axial movement between the first bearing and the second bearing, and wherein the first bearing and the second bearing constrain a boundary of axial movement of the second element, wherein movement of the drill string causes torsional oscillations of the second element, wherein current is induced in the conductive coils due to a changing magnetic field.

6. The system of claim 5, wherein the first element comprises a stator and the second element comprises a rotor.

7. The system of claim 6, wherein the first element is coaxial to the second element.

8. The system of claim 5, wherein the plurality of permanent magnets are disposed radially around an inner surface of the second element and are further disposed in an alternating pole arrangement.

9. The system of claim 5, wherein the system further comprises a drill bit connected to the drill string, wherein the first element and the second element are disposed inside the drill string.

10. The system of claim 5, further comprising:

a tool connected to the drill string and electrically connected to the first element.

11. The system of claim 10, wherein the tool is electrically unattached to another source of electrical power.

12. The system of claim 5, wherein:

the first element comprises a hollow cylinder and an electrically conducting coil oriented axially along a surface of the hollow cylinder; and the second element comprises a second cylinder in which the plurality of permanent magnets are embedded.

13. A device comprising:

a drill string comprising a casing and a drill bit;

a tool disposed inside the casing of the drill string, the tool comprising an electrical connection and an electrically powered mechanism; and a vibrational energy harvester connected to the drill string and electrically connected to the electrical connection, wherein the vibrational energy harvester comprises:

a stator comprising a conductive coil, the stator being fixedly coupled to the drill string such that the stator rotates with the drill string during a drilling operation;

a rotor comprising a plurality of magnets disposed outside the conductive coil, wherein the rotor is unpowered and the rotor is free to rotate outside the conductive coil;

a first bearing disposed proximate a first axial end of the rotor; and a second bearing disposed proximate a second axial end of the rotor, wherein the rotor is supported for free axial movement between the first bearing and the second bearing, and wherein the first bearing and the second bearing constrain a boundary of axial movement of the rotor.

14. The device of claim 13, wherein the tool comprises a wellbore monitoring device.

15. The device of claim 13, wherein:

the stator comprises a hollow cylinder and an electrically conducting coil oriented axially along a surface of the hollow cylinder; and the rotor comprises a second cylinder in which is embedded the plurality of magnets.

16. The device of claim 15, wherein the plurality of magnets are oriented axially along the rotor, and wherein the plurality of magnets are disposed around an inside surface of the rotor in an alternating pole arrangement.

17. The device of claim 13, wherein the rotor is suspended and free to rotate within a viscous fluid.

18. The device of claim 17, wherein vibrations generated by engagement of the drill bit with a bottom of a wellbore during the drilling operation cause the rotor to oscillate relative to the stator, thereby inducing an alternating electrical current in the conductive coil.

* * * * *